US006769970B1

(12) United States Patent
Taylor et al.

(10) Patent No.: US 6,769,970 B1
(45) Date of Patent: Aug. 3, 2004

(54) FLUID VENTING PLATEN FOR OPTIMIZING WAFER POLISHING

(75) Inventors: Travis Robert Taylor, Fremont, CA (US); Alan Jensen, White Salmon, WA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/186,909

(22) Filed: Jun. 28, 2002

(51) Int. Cl.[7] ..... B24B 1/00
(52) U.S. Cl. ..... 451/59; 451/41; 451/288
(58) Field of Search ..... 451/28, 41, 59, 451/287–289, 303, 307

(56) References Cited

U.S. PATENT DOCUMENTS

| | | | | |
|---|---|---|---|---|
| 5,558,568 A | | 9/1996 | Talieh et al. | |
| 5,692,947 A | | 12/1997 | Talieh et al. | |
| 5,722,877 A | | 3/1998 | Meyer et al. | |
| 5,800,248 A | * | 9/1998 | Pant et al. | 451/41 |
| 5,882,417 A | * | 3/1999 | van de Ven et al. | 118/728 |
| 5,916,012 A | | 6/1999 | Pant et al. | |
| 6,120,608 A | * | 9/2000 | Shendon et al. | 118/728 |
| 6,155,915 A | * | 12/2000 | Raeder | 451/285 |
| 6,352,470 B2 | * | 3/2002 | Elledge | 451/285 |
| 2003/0153245 A1 | * | 8/2003 | Talieh et al. | 451/8 |
| 2003/0153246 A1 | * | 8/2003 | Desai et al. | 451/8 |
| 2003/0181143 A1 | * | 9/2003 | Young et al. | 451/41 |

FOREIGN PATENT DOCUMENTS

| | | |
|---|---|---|
| EP | 0 706 857 A | 4/1996 |
| EP | 0 914 906 A | 5/1999 |
| WO | WO 00 25982 A | 5/2000 |

* cited by examiner

*Primary Examiner*—Joseph J. Hail, III
*Assistant Examiner*—David B. Thomas
(74) *Attorney, Agent, or Firm*—Martine & Penilla, LLP

(57) ABSTRACT

A platen is provided for use in a chemical mechanical planarization (CMP) system. The platen includes at least one fluid output zone having a plurality of fluid outlets, the at least one fluid output zone being disposed below a polishing pad and being capable of providing fluid pressure to the polishing pad. The platen also includes at least one fluid input zone having a plurality of fluid inlets, the at least one fluid input zone being disposed below the polishing pad and being capable of removing the fluid pressure. The platen is capable of managing fluid pressure applied to the polishing pad to achieve a particular polishing profile during a CMP operation.

30 Claims, 15 Drawing Sheets

FLUID VENTING PLATEN FOR OPTIMIZING WAFER POLISHING

BACKGROUND OF THE INVENTION

1. Field of the Invention

This invention relates generally to chemical mechanical planarization apparatuses, and more particularly to methods and apparatuses for optimizing chemical mechanical planarization applications by optimizing the controllability of a fluid bearing generated by a platen.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess material.

A chemical mechanical planarization (CMP) system is typically utilized to polish a wafer as described above. A CMP system typically includes system components for handling and polishing the surface of a wafer. Such components can be, for example, a rotary polishing pad, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface is planarized substantially. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16. The linear polishing apparatus 10 utilizes a polishing belt 12, which moves linearly in respect to the surface of the wafer 16. The belt 12 is a continuous belt rotating about rollers (or spindles) 20. A motor typically drives the rollers so that the rotational motion of the rollers 20 causes the polishing belt 12 to be driven in a linear motion 22 with respect to the wafer 16.

A wafer carrier 18 holds the wafer 16. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12 while applying pressure to the polishing belt. The polishing belt 12 is a continuous belt typically made up of a polymer material such as, for example, the IC 1000 made by Rodel, Inc. layered upon a supporting layer. The polishing belt 12 is rotated by the rollers 20 which drives the polishing belt in the linear motion 22 with respect to the wafer 16. In one example, a fluid bearing platen 24 supports a section of the polishing belt under the region where the wafer 16 is applied. The platen 24 can then be used to apply fluid against the under surface of the supporting layer. The applied fluid thus forms a fluid bearing that creates a fluid pressure on the underside of the polishing belt 12 which is applied against the surface of the wafer 16. Additionally, typical platen designs tend to use a significant amount of fluid to produce a fluid bearing between the platen 24 and the polishing pad 12. In one example, high flow regulators are utilized to input air through the platen 24. Unfortunately, by use of a high flow regulator, large amounts of air are utilized during a CMP operation. Large usage of fluid can lead to increased wafer production cost and therefore is generally undesirable. Generally, uniformity is desired where the material removal rate is evenly distributed across the entire contact surface that interfaces with the wafer so the wafer surface becomes substantially planar. This typically requires control of polishing pressure applied by the fluid bearing. But, there can be times where polishing pressure in different regions of the wafer is desired to be varied such as times when oxide deposition on the wafer has a distinctive thickness profile as discussed below in reference to FIGS. 1C and 1D.

FIG. 1C shows a graph 30 illustrating a profile of non-uniform oxide deposition on a wafer. In this example, the oxide layer that has been deposited is thicker in the center and the edge of the wafer and thinner in the area between the center and the edge. This can occur due to equipment optimization limitations. Therefore, when platens that apply uniform polishing pressure across the wafer are utilized resulting in a uniform removal rate, the original non-uniformity from the deposition is preserved after planarization. Thus, when, for example, the oxide layer that has been applied is thicker in the center and the edge and thinner in the areas in between, this may result in too little polishing in the edge and center portions of the wafer and too much polishing in the other regions of the wafer. Unfortunately, because prior art platens are configured to only outputs fluids from outlets, wafer polishing profiles typically cannot be managed to match many wafer thickness profiles.

FIG. 1D shows a graph 40 of another exemplary profile of an non-uniform oxide layer that has been deposited on the wafer. In this example, if a wafer that is thicker in the edge and thinner in the middle is polished, the polishing can result in too much removal of oxide in the center region while too little removal takes place in the edge regions of the wafer. Therefore, the wafer with the thickness profile as shown in graph 40 may not polished to a substantially planar surface.

As shown by FIGS. 1C and 1D, there are numerous types of wafer thickness profiles that can occur with different oxide deposition equipment from different manufacturers. Therefore, wafer polishing equipment attempting to apply uniform polishing pressure across the wafer is not able to adjust polishing pressures throughout the various portions of the wafer. Such resultant non-uniform wafer thicknesses may be undesired and can be detrimental to efficient wafer processing operations.

In view of the foregoing, there is a need for an apparatus that overcomes the problems of the prior art by having a platen that can effectively control different polishing pressure profiles during CMP operations.

SUMMARY OF THE INVENTION

Broadly speaking, embodiments of the present invention fill these needs by providing a platen that enables management and control of polishing pressure in different parts of the wafer during a CMP process by having the ability to increase or decrease fluid pressure in different areas over the platen. The platen may do this by having fluid outlets and fluid inlets to output and input air flow. It should be appreciated that the present invention can be implemented in numerous ways, including as a process, an apparatus, a system, a device, or a method. Several inventive embodiments of the present invention are described below.

In one embodiment, a platen is provided for use in a chemical mechanical planarization (CMP) system. The platen includes at least one fluid output zone having a plurality of fluid outlets, the at least one fluid output zone being disposed below a polishing pad and being capable of providing fluid pressure to the polishing pad. The platen also includes at least one fluid input zone having a plurality of fluid inlets, the at least one fluid input zone being disposed below the polishing pad and being capable of removing the fluid pressure. The platen is capable of managing fluid pressure applied to the polishing pad to achieve a particular polishing profile during a CMP operation.

In another embodiment, a method for wafer planarization using a linear chemical mechanical planarization (CMP) system is provided. The CMP system has a platen with at least one fluid input zone and at least one fluid output zone disposed below a polishing pad. The method includes outputting fluid from at least one fluid output zone to an underside of the polishing pad to increase fluid pressure on the polishing pad. The method further includes inputting fluid into at least one fluid input zone to decrease the fluid pressure on the polishing pad. The increasing of the fluid pressure on the polishing pad increases polishing pressure on a wafer and the decreasing of the fluid pressure on the polishing pad decreases polishing pressure on the wafer. Each of the at least one fluid output zone and each of the at least one fluid input zone are capable of being managed to achieve a particular polishing profile.

In yet another embodiment, a platen is provided which includes a surface capable of supporting a portion of a polishing pad. The platen also includes a plurality of outlets located throughout the surface, each of the plurality of outlets being capable of outputting a fluid toward an underside of the polishing pad. The platen further includes a plurality of inlets located throughout the surface, each of the plurality of inlets being capable of removing the fluid away from the underside of the polishing pad.

Because of the advantageous effects of increasing and decreasing controlled pressure to and from various areas of the wafer, embodiments of the present invention provide significant improvement in planarization and control over polishing profiles. Specifically, the platen described herein includes both at least one fluid out region and at least one fluid input region. In addition, embodiments of the platen utilize less fluid output zones thereby using less fluid than prior art platens while still enabling the optimization of polishing profiles. Consequently, the platen may not only control polishing in various portions of the wafer, but in addition, the platen may use significantly less fluid than prior art platens. Therefore, the platen described herein increases wafer production efficiency and decreases wafer production costs. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

Figure 1A:
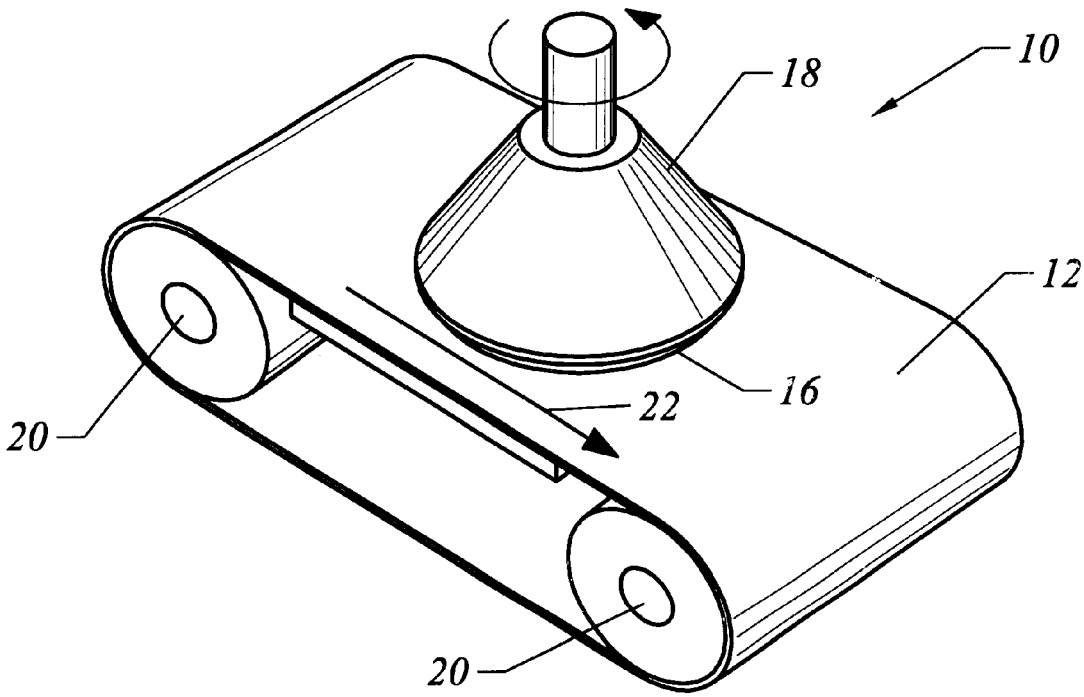
FIG. 1A shows a linear polishing apparatus which is typically utilized in a CMP system.
Figure 1B:
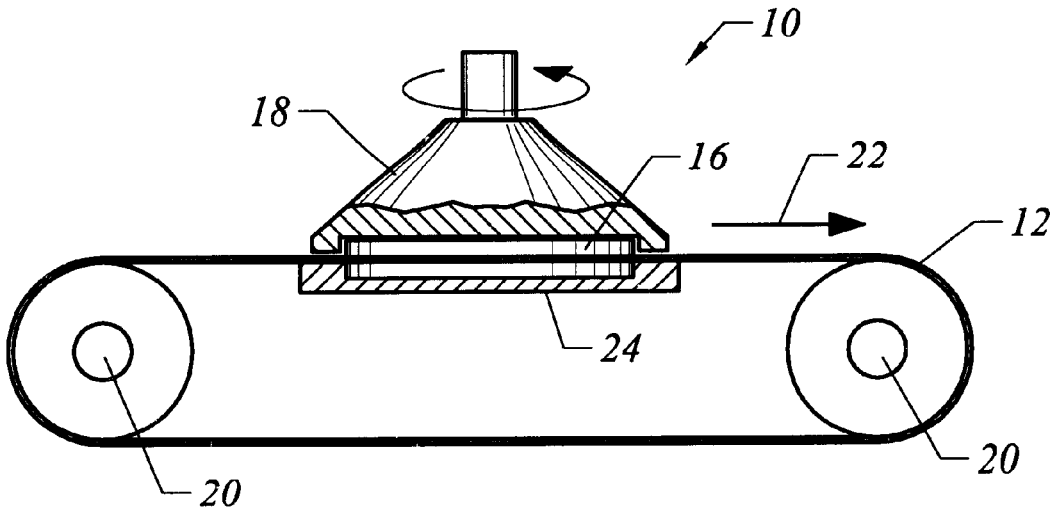
FIG. 1B shows a side view of the linear polishing apparatus.
Figure 1C:
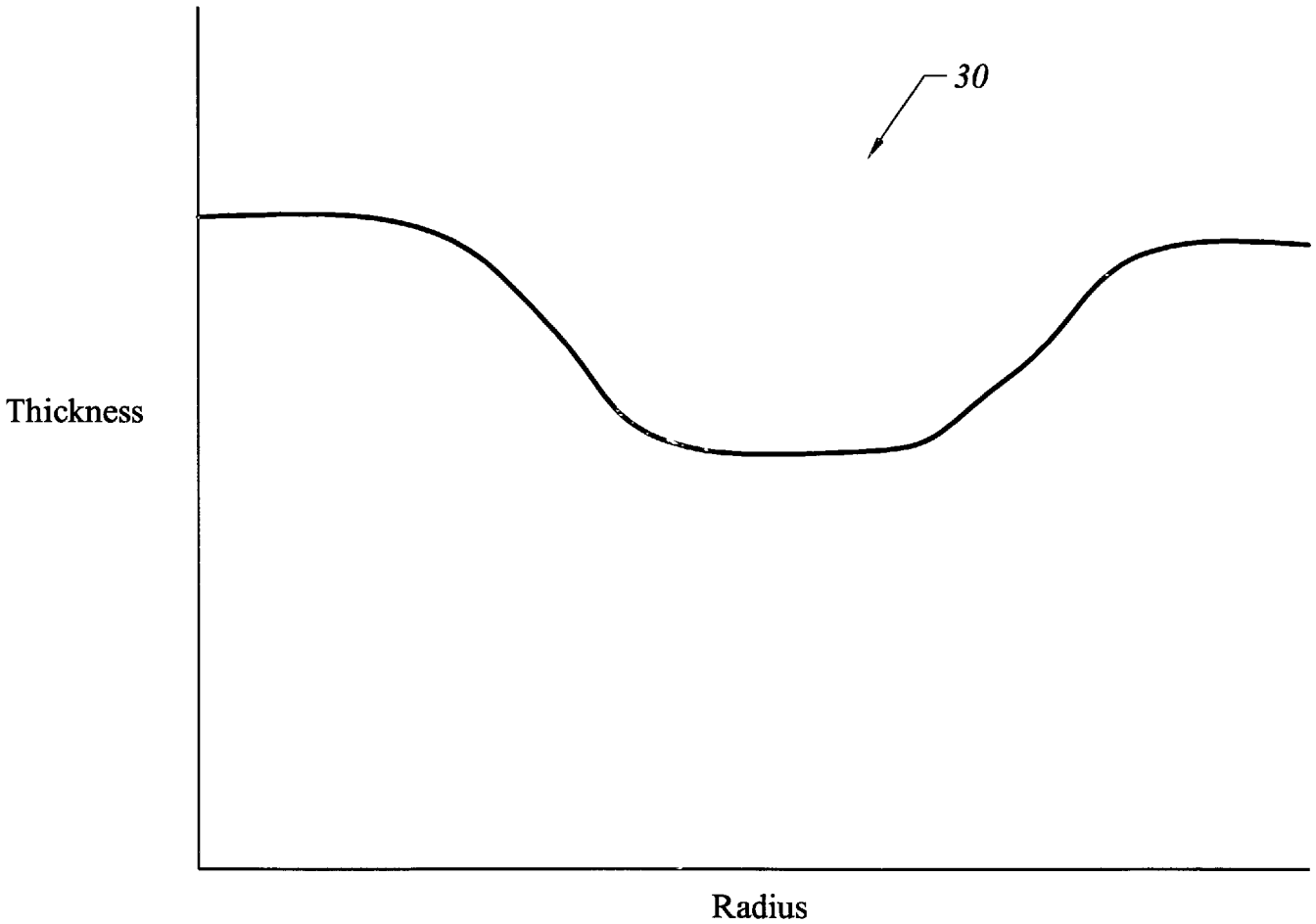
FIG. 1C shows a graph illustrating a profile of non-uniform oxide deposition on a wafer.
Figure 1D:
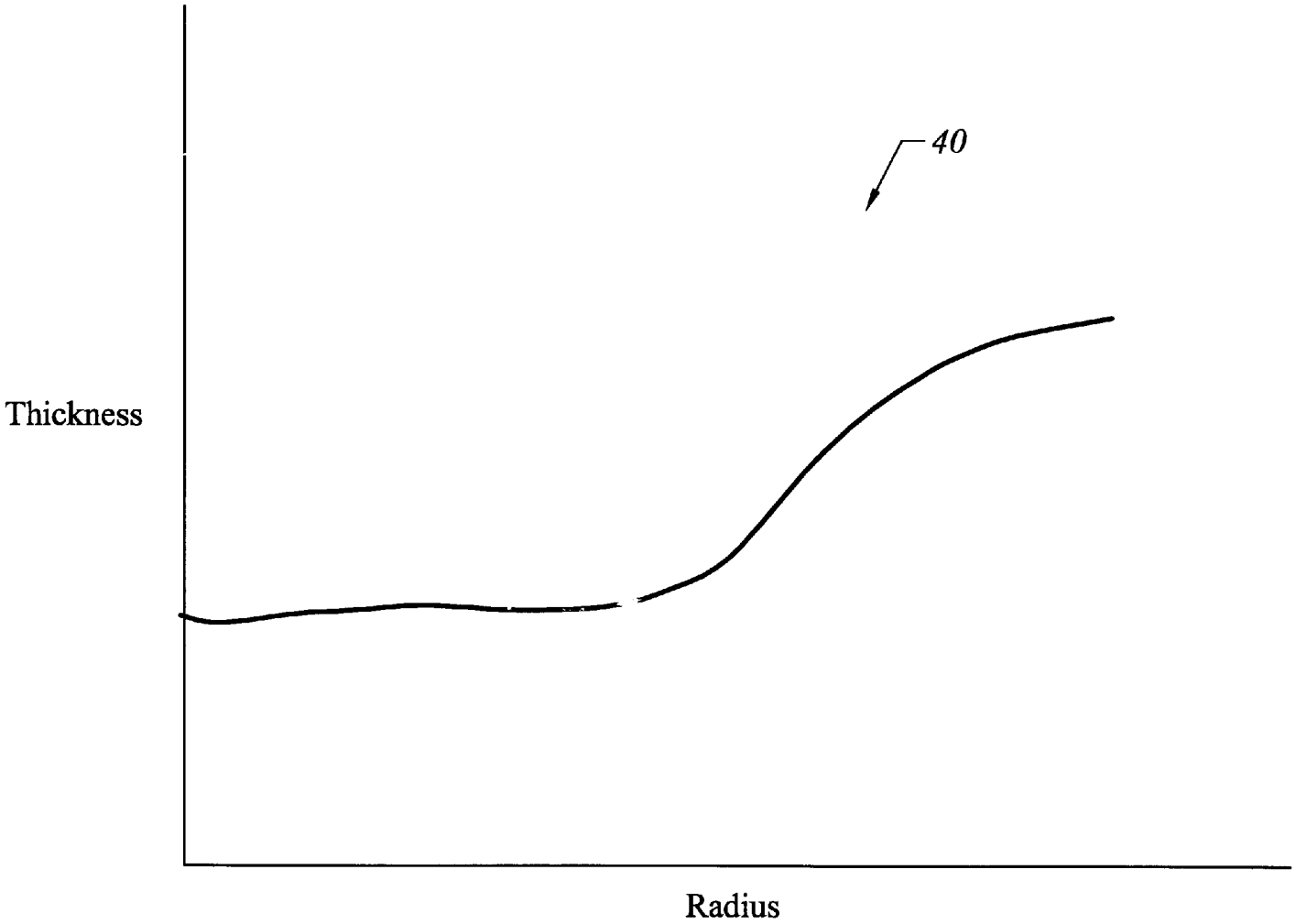
FIG. 1D shows a graph of another exemplary profile of an non-uniform oxide layer that has been deposited on the wafer.

An invention is disclosed for a platen that provides wafer polishing profile control during a CMP process utilizing fluid pressure optimization zones. The platen described herein may both increase fluid pressure over a specified area of the platen and/or decrease fluid pressure from a specified area over the platen. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

In general, embodiments of the present invention provide a platen within a CMP system that has the unique ability to independently increase and/or decrease polishing pressure on nearly any region of the wafer enabling wafer polishing profiles to be better managed and controlled thus leading to optimized wafer processing operations. In one embodiment, the platen includes at least one fluid output zone and at least one fluid input zone. As a result, non-uniform deposition of substances on wafers may be accounted for by adjusting a polishing profile to match the differing thicknesses in different regions of the wafer.

A platen of the embodiments of the present invention may include any suitable number or configuration of at least one fluid input zone (also known as an increased pressure zone) and/or at least one fluid output zone (also known as a decreased pressure zone). Each different pressure zone corresponds to a platen zone with a plurality of fluid holes. The platen zones may be utilized to output fluid and/or input at different pressures thus compensating for wafers with non-uniform substance deposition thicknesses such as, for example, an oxide deposition layer, that is desired to be planarized. It should be appreciated that any suitable type of substance may be planarized using the platen described herein. It should also be understood that the embodiments of the present invention can be utilized for polishing any size wafer such as, for example, 200 mm wafers, 300 mm wafers, etc. Therefore, the platen described herein may be any suitable size depending on the application desired.

A fluid as utilized herein may be any type of gas (e.g. clean dry air) or liquid (e.g. water). Preferably, clean dry air is utilized as the fluid. Therefore, fluid platens as described below may utilize gas or liquid to control pressure applied by a polishing pad to a wafer. In addition, embodiments of the present invention can implement mechanical devices to provide and remove pressure to the polishing belt such as, for example, piezoelectric elements, vacuum generation devices, etc. In one embodiment, the air inflow to a particular fluid output zone may be between about 0–50 psi in platens utilized for polishing 200 mm wafers and between about 0–70 psi in platens utilized for polishing 300 mm wafers.

Figure 2:
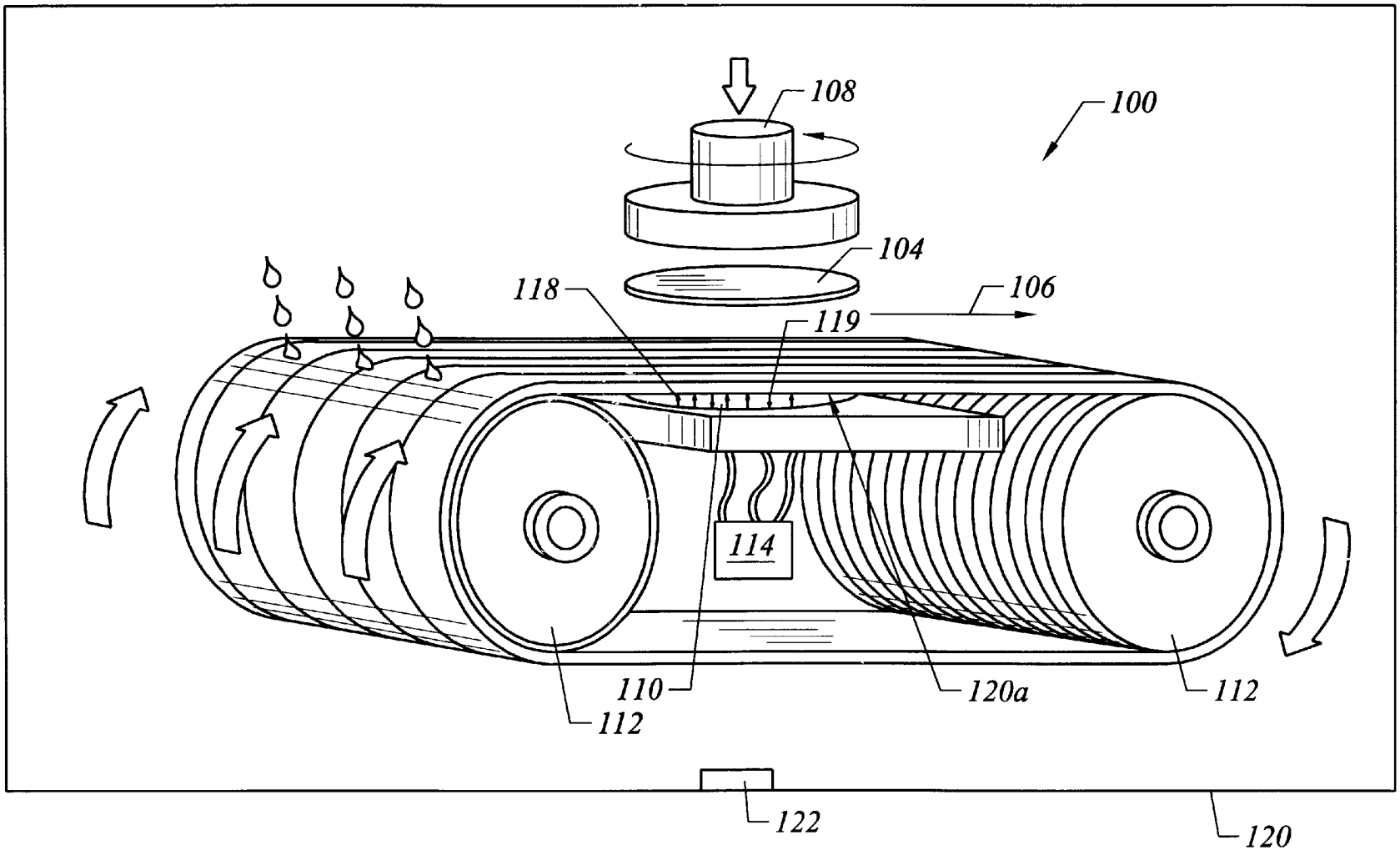
FIG. 2 shows a side view of a wafer linear polishing apparatus in accordance with one embodiment of the present invention.

FIG. 2 shows a side view of a wafer linear polishing apparatus 100 in accordance with one embodiment of the present invention. In this embodiment, a carrier head 108 may be used to secure and hold a wafer 104 in place during processing. A polishing pad 102 preferably forms a continuous loop around rotating drums 112. The polishing pad 102 generally moves in a direction 106 at a speed of about 400 feet per minute, however, it should be noted that this speed may vary depending upon the specific CMP operation. As the polishing pad 102 moves linearly, the carrier 108 may then be used to lower the wafer 104 onto a top surface of the polishing pad 102.

A platen 110 may support the polishing pad 102 during the polishing process. The platen 110 has a top surface that is also known as a support surface where a plurality of fluid outlets and a plurality of fluid inlets may be located. The platen 110 may utilize any type of fluid bearing such as a liquid bearing or a gas bearing. Fluid pressure from a fluid source 114 outputted from the platen 110 by way of independently controlled pluralities of outlet holes may be utilized to provide upward force 118 to a polishing pad underside 102*a* to control the polishing pad profile. The fluid pressure is generated by outputting fluid from the plurality of fluid outlets located on the top surface of the platen 110. Therefore, increased fluid pressure over a particular platen zone increases polishing pressure over the particular platen zone, and decreased fluid pressure over the particular platen zone decreases polishing pressure over the particular platen zone. Fluid pressure may be removed by inputting fluid from the fluid bearing into the plurality of fluid inlets. In one embodiment, the fluid source 114 may be a manifold or a regulator managed by a controller. Such a fluid source may control the fluid pressure applied to various polishing regions over the platen 110. In one exemplary embodiment, the fluid source 114 may be connected by tubes to the platen 110 where each of the tube(s) may correspond with a region of the platen where fluid is outputted. Therefore, it should be appreciated that there may be any suitable number of tubes depending on the configuration of the platen. Therefore, the fluid source 114 may be utilized to apply any suitable pressure to different independently controllable regions of the platen 110 where fluid outlets exist. It should also be appreciated that the fluid source 114 may be located in a different location apart from the apparatus 100 as long as the fluid source 114 may be connected with the platen 110.

Moreover, in one embodiment, the platen 110 may have zones with a plurality of fluid inlets through which fluid may be removed from a fluid bearing generated by the output of fluid by the fluid source 114 through the platen 110. Fluid pressure may be removed by inputting fluid from the fluid bearing into the plurality of fluid inlets. A low pressure region 119, as a result of air flowing into the platen, is shown which may be generated over any suitable zone of the platen 110 depending on the platen configuration. The inputting fluid from the fluid bearing into the plurality of fluid inlets may also be known as venting. Additionally, tube(s) coming from region(s) of the platen where fluid is inputted may be utilized to remove fluid from the fluid bearing between the platen 110 and the polishing pad 102. In one embodiment, each of the separately controllable platen zones has a corresponding tube entering an underside of the platen 110 that may either supply fluids or remove fluids. In this way, the number of tubes connecting to the platen 110 may correspond with the number of independently controlled fluid delivery and removal regions on the platen 110. It should be appreciated that the tubes carrying fluid removed from above the platen 110 may lead to any suitable location where the fluid may be disposed away from the platen 110. In one embodiment, the tubes with the removed fluid can expel the fluid onto the side of a tub 120 in which the apparatus 100 resides. The tub 120 may have a drain 122 to remove the fluid as well as other substances such as slurry and water. Independently controlled fluid outlets are outlets that may each have different flow rates of fluid depending on the polishing rate and the polishing rate profile desired. FIGS. 3A through 5 below show exemplary platen embodiments where polishing pressure application and reduction may be generated by at least one fluid output zone and at least one fluid input zone.

Figure 3A:
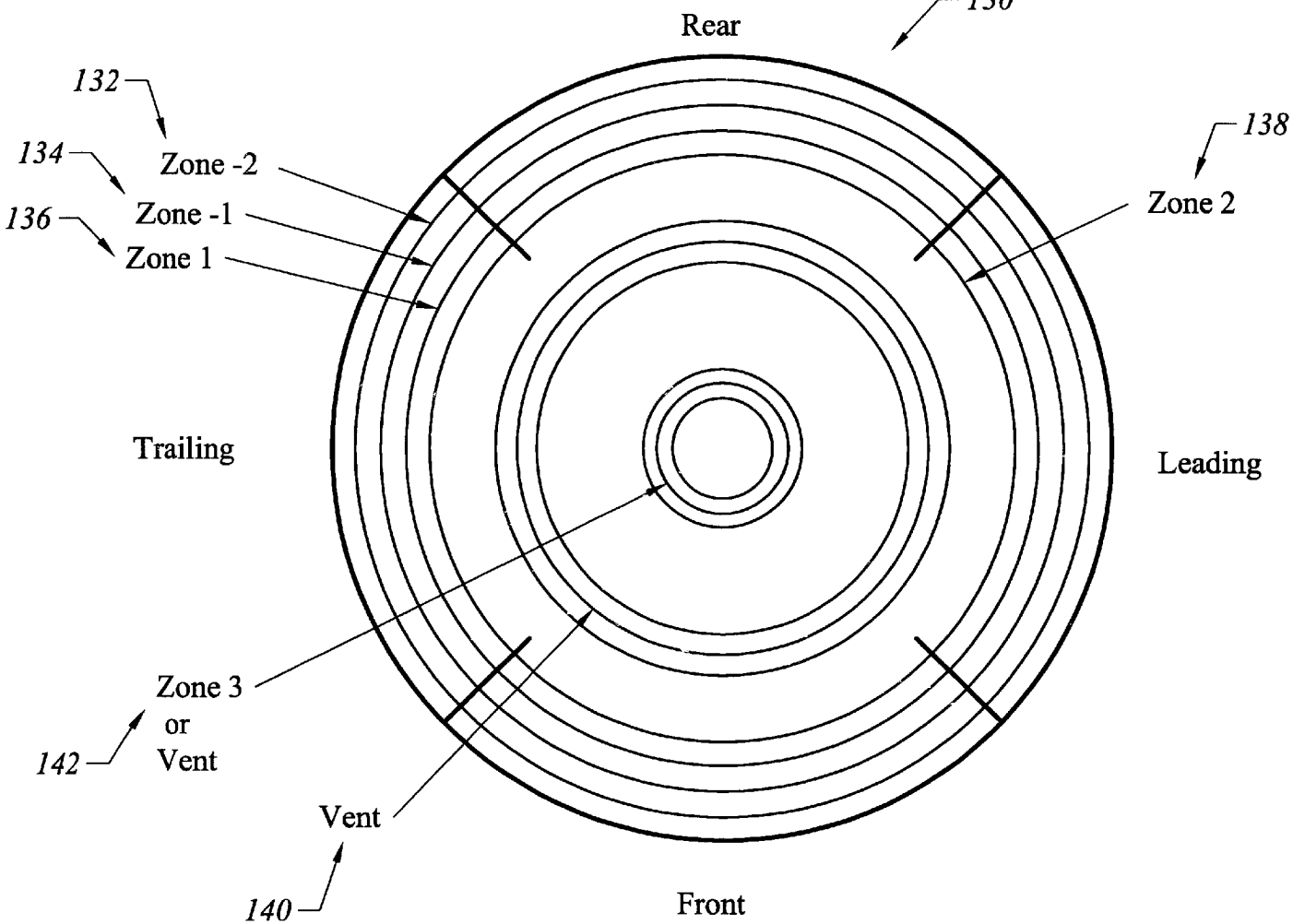
FIG. 3A shows a top view of a polishing zone layout of the platen in accordance with one embodiment of the present invention.

FIG. 3A shows a top view of a polishing zone layout 130 of the platen 110 in accordance with one embodiment of the present invention. As described above with respect to FIG. 2, the polishing pad 102 moves in a direction 106 producing a friction which assists in the polishing process. The process of wafer linear polishing occurs as a result of the movement of the polishing pad 102 and the pressing down of the wafer 104 onto the polishing pad 102. The wafer 104 is typically rotated in a direction 108 during the CMP process.

It should be appreciated that the platen 10 may have any suitable number of fluid output zones and any suitable number of fluid input zones on a top surface of the platen 110 depending on the polishing profile desired. In one embodiment, the platen 110 may have four fluid output zones which enables increasing of polishing pressure, one fluid input zone (also known as a venting region or zone), and one zone that may be a fluid input zone or a fluid output zone. In this embodiment, the polishing zone layout 130 includes fluid output zones 132, 134, 136, and 138. In one embodiment, each of the fluid output zones 132, 134, 136, and 138 are a plurality of outlets on a top surface of the platen 110. In a preferrable embodiment, each of the fluid output zones 132, 134, 136, and 138 is a radial row of openings where fluid may be outputted. The term radial rows as utilized herein are circular rows that are concentric with all other radial rows and have a common center with the platen 110. Polishing pressure over the fluid output zones 132, 134, 136, and 138 are generated by supplying fluid pressure from radial rows of a plurality of fluid outlets for each of the output zones 132, 134, 136, and 138. The fluid pressure is applied to the underside 102*a* of the polishing pad 102 by the fluid output zones 132, 134, 136, and 138.

The polishing zone layout 130 may also include fluid input zone 140. Fluid pressure may also be removed from the underside 102*a* of the polishing pad 102 through the fluid input zone 140 thereby decreasing polishing pressure on the wafer. It should be appreciated that the fluid input zone 140 may include any suitable number of radial rows of a plurality of fluid inlets. In a preferable embodiment, the fluid input zone 140 includes three radial rows of a plurality of fluid inlets.

Zone 142 may be either a fluid input zone or a fluid output zone depending on the configuration of the platen 110. In one embodiment, the zone 142 may be either a fluid input zone or a fluid output zone. In a preferable embodiment, the zone 142 includes 3 radial rows of a plurality of fluid inlets or outlets depending on whether the zone 142 is a fluid input zone or a fluid output zone. As described herein, inlets and outlets located on a top surface of the platen 110 may be any suitable type of opening that enables controllable fluid transmission. In a preferable embodiment, the opening is a hole of suitable diameter to provide controlled fluid transmission.

The polishing zone layout 130 is for a 200 mm platen design, and during polishing, the fluid output zones 132 and 134 are located outside of the circumference of the wafer 104.

Figure 6A:
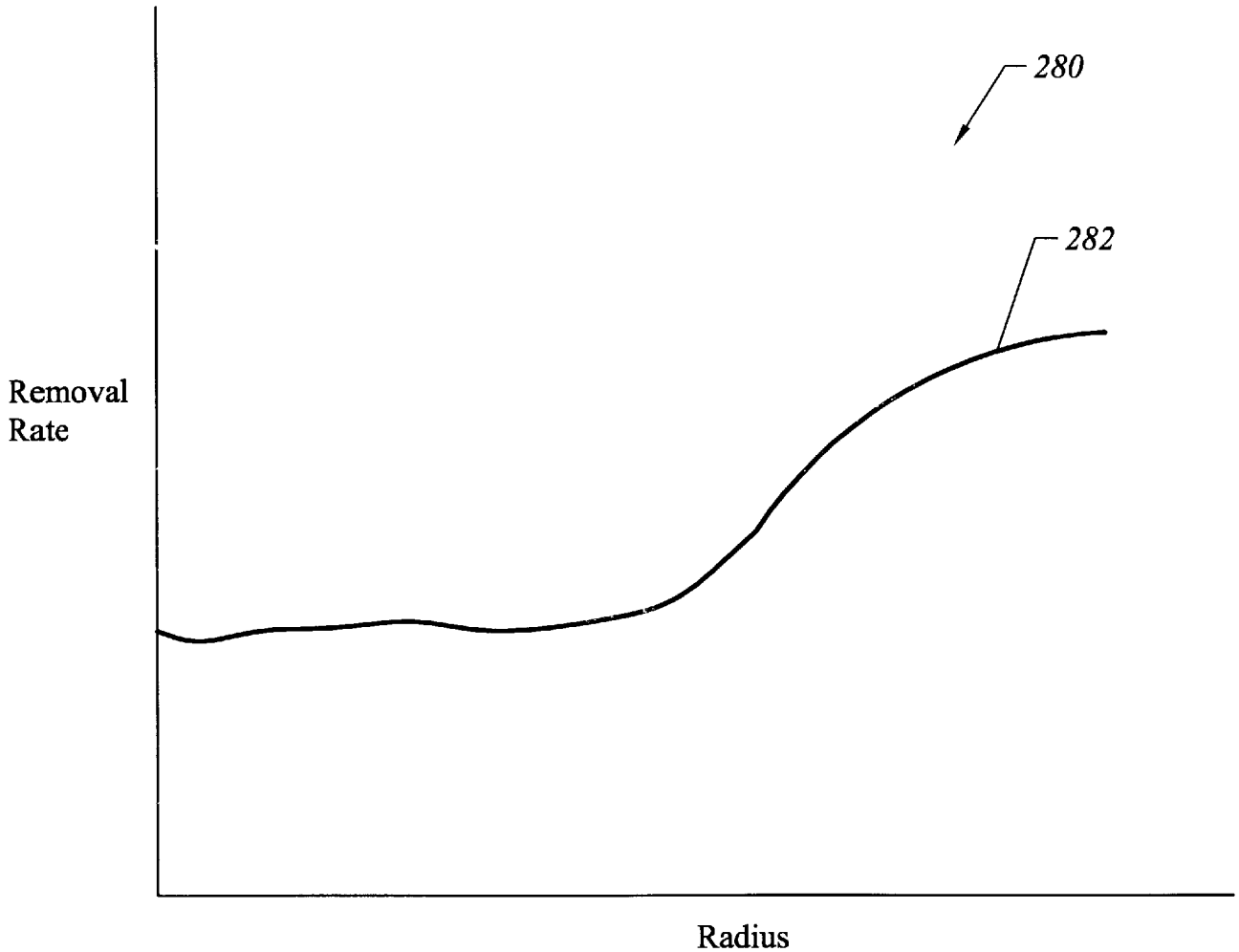
FIG. 6A shows a graph illustrating a polishing profile of a wafer in accordance with one embodiment of the present invention.
Figure 6B:
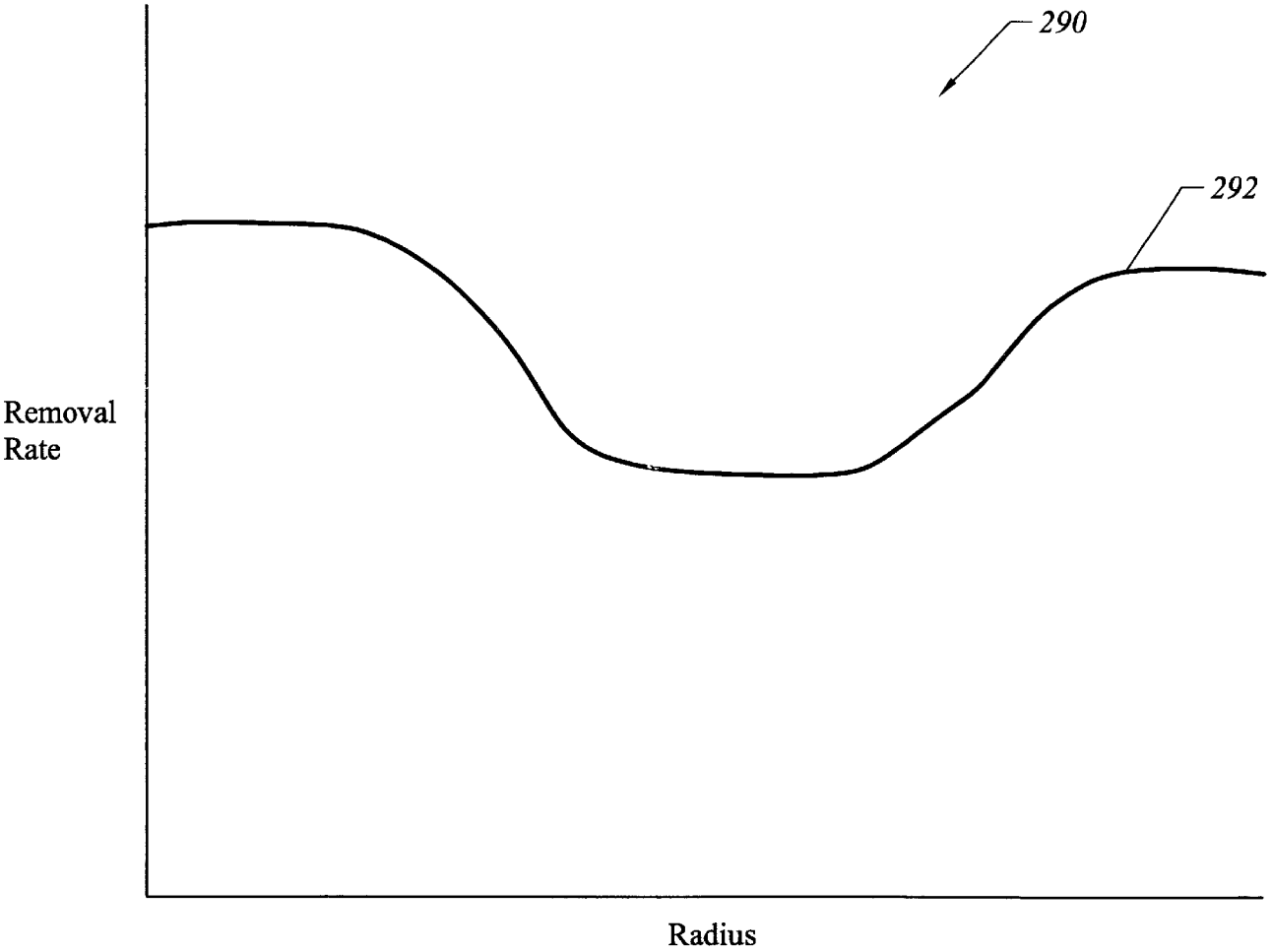
FIG. 6B shows a graph illustrating an additional polishing profile of a wafer in accordance with one embodiment of the present invention.

Depending on how much fluid pressure is applied or removed by the platen 110 to the polishing pad 102 that correspond to those zones, polishing rates in different zones 132 through 140 may be optimally managed. In one embodiment, if a polishing profile as discussed in reference to FIG. 6A is desired, the zones 132, 134, 136, and 138 may be utilized to output fluid out of the platen thereby increasing polishing pressure over those zones while the zones 140 and 142 may be utilized to input fluid into the platen thereby decreasing polishing pressure over zones 140 and 142. In another embodiment, if a polishing profile as discussed in reference to FIG. 6B is desired, the zones 132, 134, 136, 138, and 142 may be utilized to output fluid out of the platen thereby increasing fluid pressure over those zones (and hence increases polishing pressure) while the zone 140 may be utilized to input fluid into the platen thereby decreasing fluid pressure (and hence decreases polishing pressure) over the zones 140. Therefore, numerous embodiments of the platen 110 may be used to provide numerous types of polishing profiles. In one embodiment, each of the zones the platen 110 may each form a circular ring on the platen. In another embodiment, the platen 110 may be divided into quadrants with four main zones (leading, trailing, front, and rear) with each of the main zones including subzones providing further fluid pressure control where each of the zones (or subzones) is capable of functioning as either outputs or inputs depending on the platen configuration.

Figure 3B:
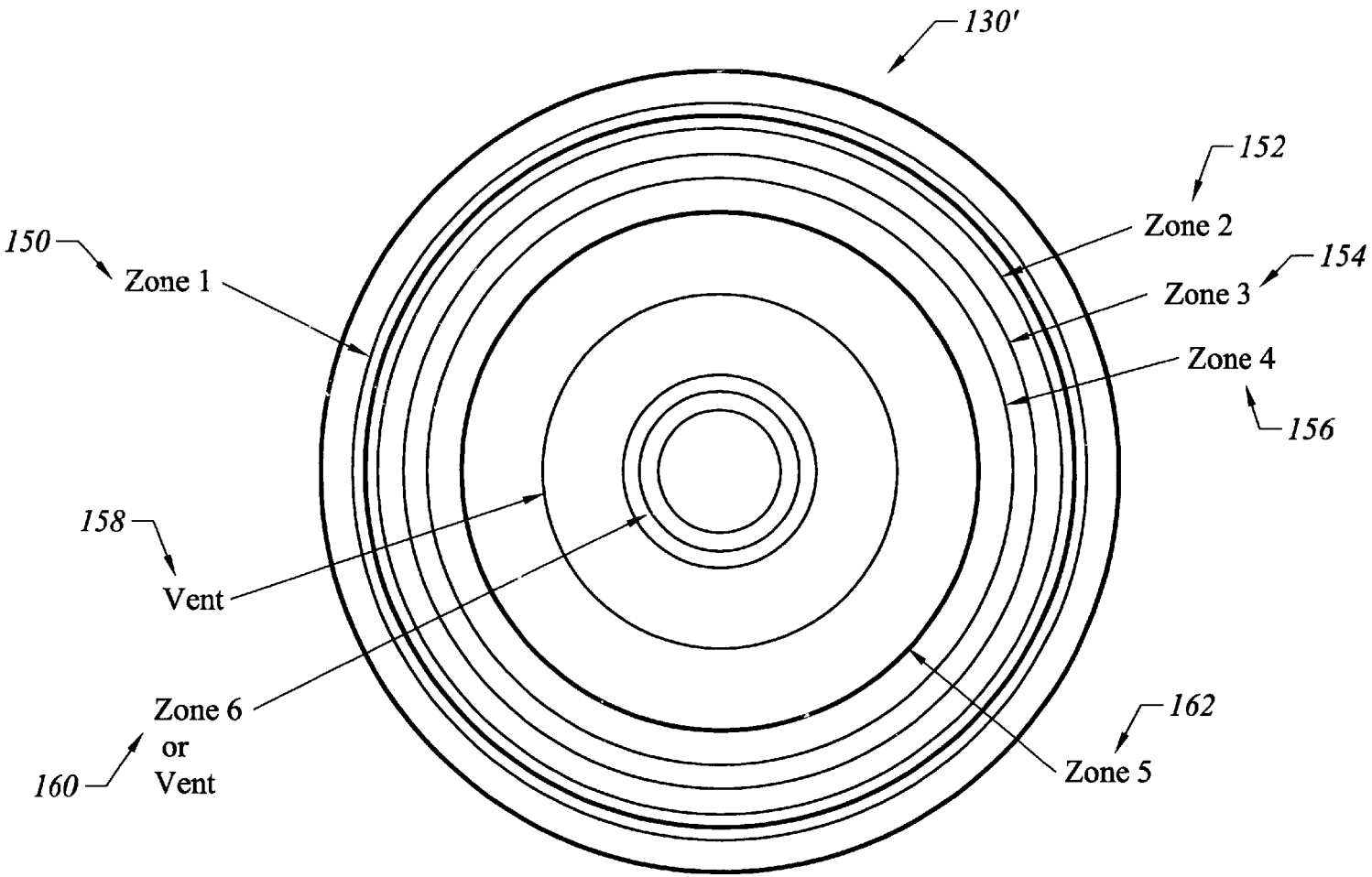
FIG. 3B shows a top view of another polishing zone layout of the platen in accordance with one embodiment of the present invention.

FIG. 3B shows a top view of another polishing zone layout 130' of the platen 110 in accordance with one embodiment of the present invention. As indicated above in reference to FIG. 3A, the polishing zone layout 130' is just one of many different polishing zone layouts that may be utilized. Therefore, it should be appreciated that the platen 110 may have any suitable number of fluid output zones and any suitable number of fluid input zones on the top surface of the platen 110 depending on the polishing profile desired. In one embodiment, the platen 110 may have five fluid output zones which enables increasing of polishing pressure, one fluid input zone (also known as a venting region or zone), and one zone that may be a fluid input zone or a fluid output zone. In this embodiment, the polishing zone layout 130' includes fluid output zones 150, 152, 154, 156, and 162. The polishing zone layout 130' may also include fluid input zone 158. The polishing zone layout 130' can also include zone 160 which may be either a fluid input zone or a fluid output zone depending on the configuration of the platen 110. The polishing zone layout 130' is for a 200 mm platen design, and during polishing, the fluid output zone 150 is located outside of the circumference of the wafer 104.

Polishing pressure over the fluid output zones 150, 152, 154, 156, and 162 are generated by outputting fluid from radial rows of a plurality of fluid outlets for each of the output zones 150, 152, 154, 156, and 162. The fluid pressure generated by the outputting of the fluid is applied to the underside 102*a* of the polishing pad 102 by the fluid output zones 150, 152, 154, 156, and 162 which in turn generates the polishing pressure.

Fluid pressure may also be removed from the underside 102*a* of the polishing pad 102 through the fluid input zone 158. The removal of the fluid pressure decreases the polishing pressure on the wafer that is over the fluid input zone 158. In one embodiment, the fluid input zone 158 includes one radial row of a plurality of fluid inlets. In one embodiment, the zone 160 may be either a fluid input zone or a fluid output zone. The zone 160 includes 3 radial rows of a plurality of fluid inlets or outlets depending on whether the zone 160 is a fluid input zone or a fluid output zone.

Figure 3C:
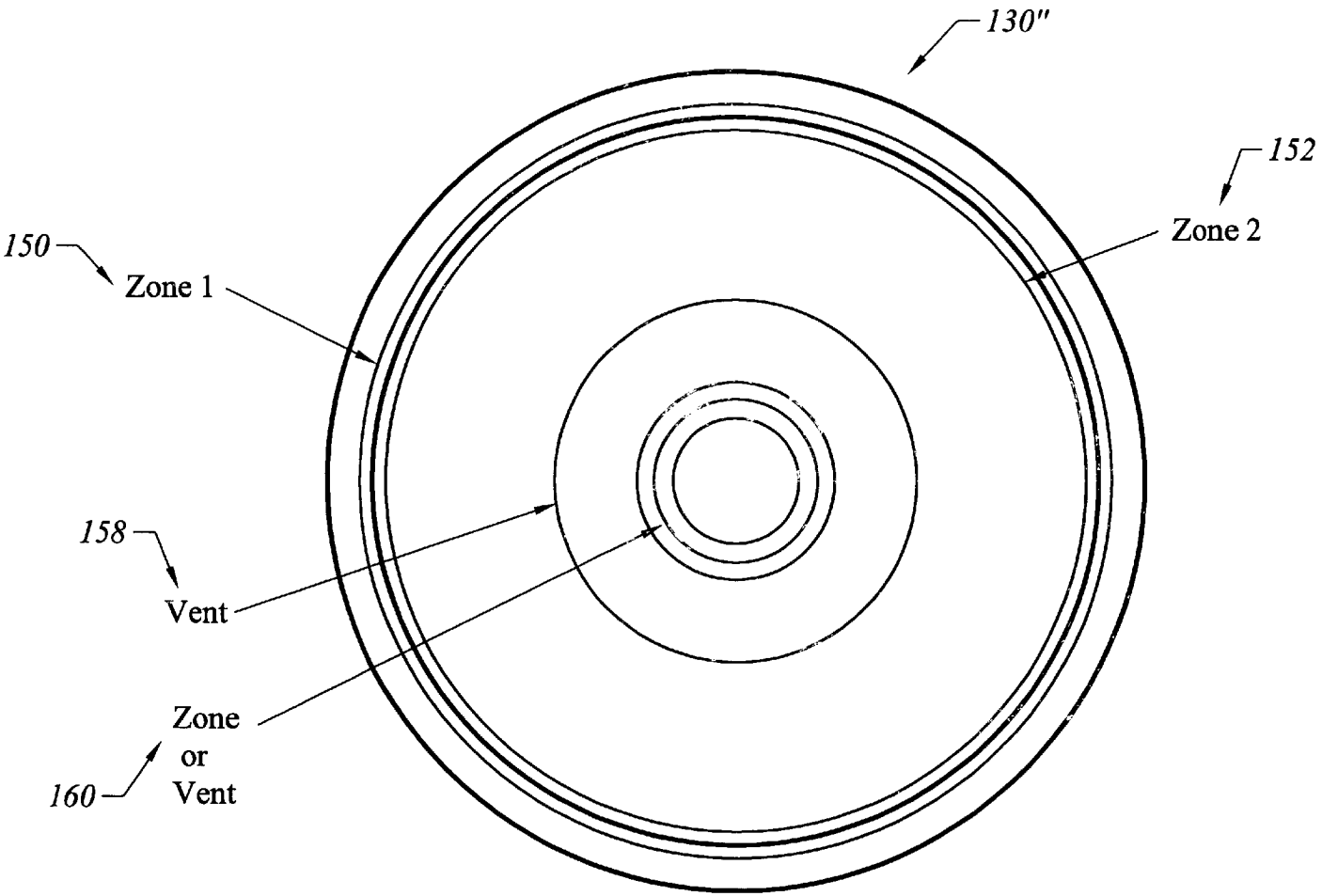
FIG. 3C shows a top view of yet another polishing zone layout of the platen that is configured to enable planarization of a non-uniform wafer surface in accordance with one embodiment of the present invention.

FIG. 3C shows a top view of yet another polishing zone layout 130" of the platen 110 that is configured to enable planarization of a non-uniform wafer surface in accordance with one embodiment of the present invention. In one embodiment, the platen 110 may have two fluid output zones which enable increasing of polishing pressure, and two fluid input zones. In this embodiment, the polishing zone layout 130" includes fluid output zones 150, 152 and 160. The polishing zone layout 130" also includes fluid input zone 158. The fluid output zone 150 is located outside of the circumference of the wafer 104 while the fluid output zone 152 is located inside of the circumference of the wafer 104. A line 159 shows the region where the outside circumference of the wafer would be located over the platen in a CMP operation.

Outputting fluid from a radial row of a plurality of fluid outlets for each of the output zones 150, 152, and 160 generates fluid pressure (and hence polishing pressure) over the fluid output zones 150, 152, and 160. The fluid pressure is applied to the underside 102*a* of the polishing pad 102 by the fluid output zones 150, 152, and 160 to assist in controlling the polishing profile to match a deposition profiles as discussed below in reference to FIGS. 6A and 6B so the resultant wafer surface after polishing may be substantially planar even through the deposition profile is non-uniform.

Fluid pressure may also be removed from the underside 102*a* of the polishing pad 102 through the fluid input zone 158 thus reducing polishing pressure on the wafer. In one embodiment, the fluid input zone 158 includes one radial row of a plurality of fluid inlets. In one embodiment, the zone 160 may be either a fluid input zone or a fluid output zone. The zone 160 includes 3 radial rows of a plurality of fluid inlets or outlets depending on whether the zone 160 is a fluid inlet zone or a fluid output zone. Therefore, in this embodiment, the fluid pressure applied by the fluid output zones 150 and 152, increase removal rate (i.e., polishing pressure) on an edge region and a center region of the wafer while the fluid inlet zone 158 reduces polishing pressure in the region in between the edge region and the center region of the wafer. The zone 160 may be utilized as either a fluid output zone or a fluid input zone depending on the polishing profile desired. This flexibility in configuration, use, and control of fluid pressures applied by the platen enables a wafer with a deposition profiles as discussed above in reference to FIGS. 6A and 6B to be substantially planarized.

Therefore, to obtain the polishing profile as shown in FIG. 6A, the fluid output zones 150 and 152 apply polishing pressure while the fluid input zones 158 and 160 remove polishing pressure. This generates a high removal rate over the zones 150 and 152 while a lower removal rate is generated over the zones 158 and 160.

To obtain the polishing profile as shown in FIG. 6B, the fluid output zones 150, 152, and 160 apply polishing pressure while the fluid input zone 158 removes polishing pressure. In this embodiment, the zone 158 is used as a fluid output zone to apply polishing pressure over the zone 158. This generates a high removal rate over the zones 150, 152, and 160 while a lower removal rate is generated over the zone 158.

In addition, because less fluid output zones exist than in typical platens, the polishing zone layout 130' can significantly reduce fluid consumption during a CMP operation. In one embodiment, the pressure to a particular fluid output zone may be between about 0–50 psi in platens utilized for polishing 200 mm wafers and between about 0–70 psi in platens utilized for polishing 300 mm wafers. By utilizing platens with less fluid output zones, low flow regulators may also be utilized to supply fluid into the platens thus conserving fluid.

Figure 4A:
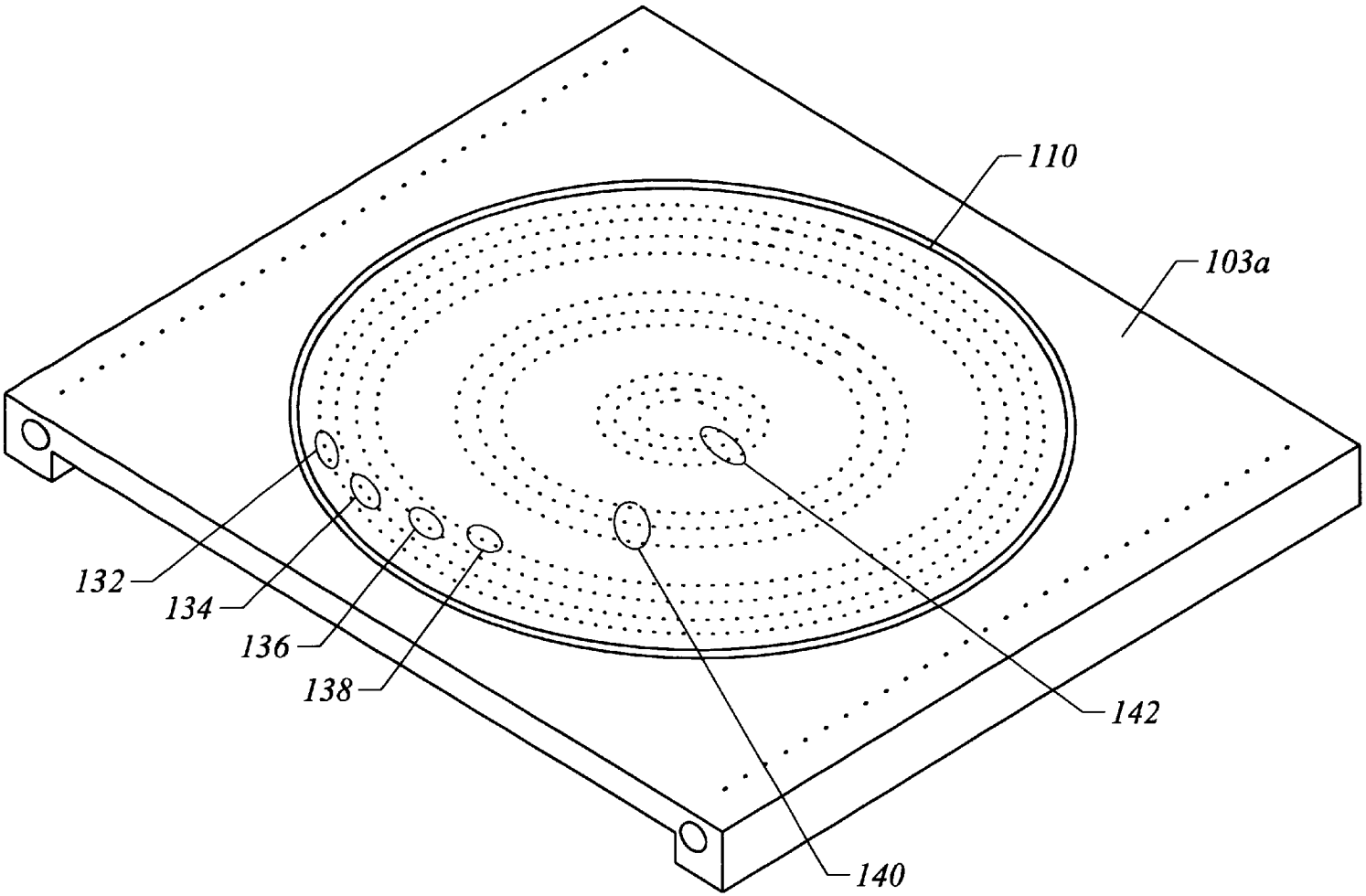
FIG. 4A is a diagram showing a top view of the platen, in accordance with one embodiment of the present invention.

FIG. 4A is a diagram showing a top view of the platen 110, in accordance with one embodiment of the present invention. The platen 110 has various platen regions having fluid output and input zones. The zones 132, 134, 136, 138, 140, and 142 may each have at least one radial row of a plurality of fluid outlets or inlets that may use fluid pressure to apply and/or remove polishing pressures to different regions of the wafer being polished. This occurs by use of fluid pressure application (generated by fluid output) from the platen 110 applied to the underside 102*a* of the polishing pad 102 (as shown in FIG. 2) and by use of fluid pressure removal (into the fluid inlet) to the platen 110 from the underside 102*a* of the polishing pad 102. It should be appreciated that the outlets and inlets may be any suitable type of aperture that may let fluids through. In one embodiment, the apertures are holes. By adjusting the fluid pressure applied to the underside 102*a* of the polishing pad, polishing pressure to the wafer which is being polished by the polishing pad may be managed.

Figure 4B:
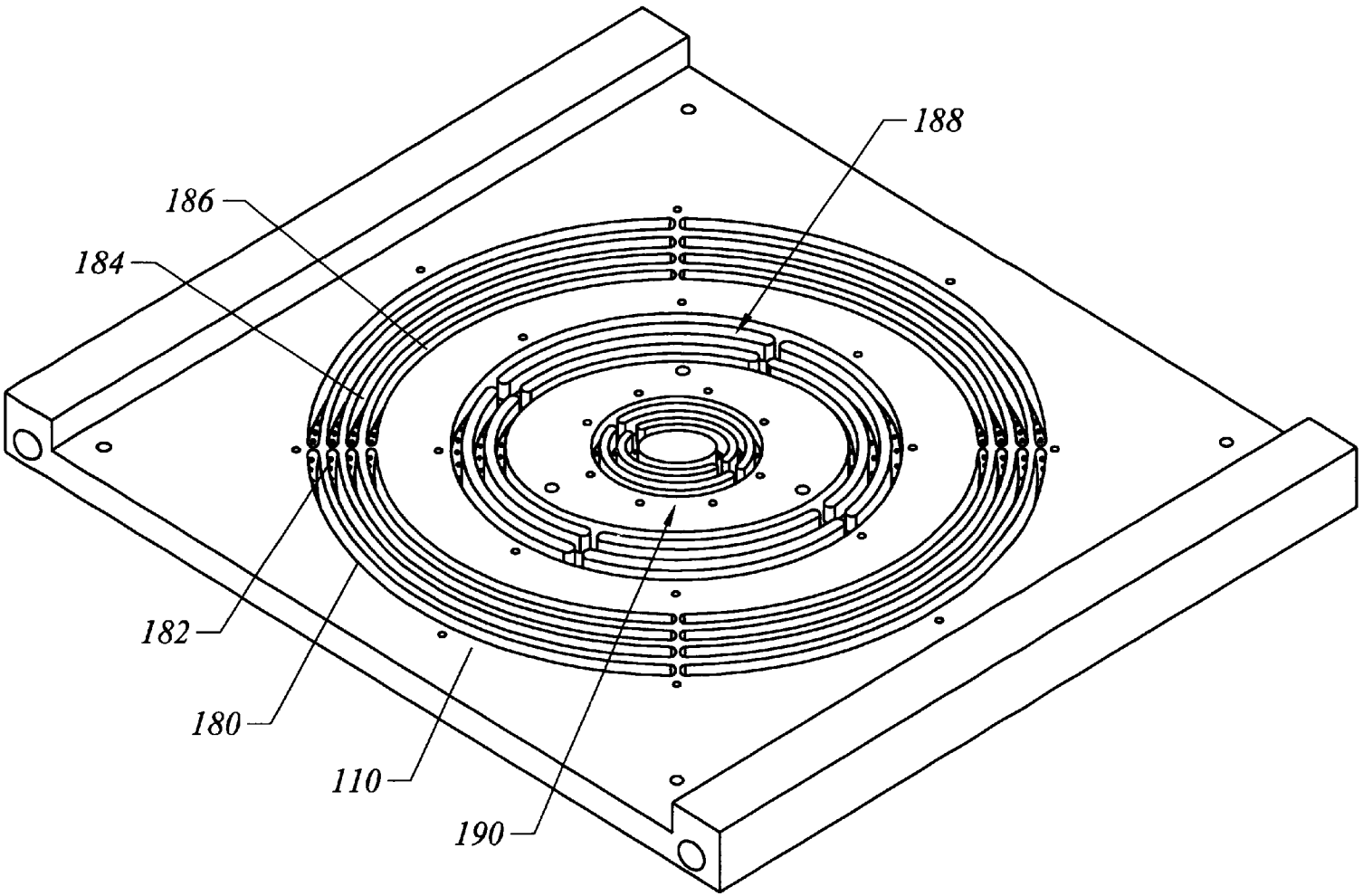
FIG. 4B shows a backside view of the platen in accordance with one embodiment of the present invention.

FIG. 4B shows a backside view 320 of the platen 110 in accordance with one embodiment of the present invention. In this embodiment, openings leading to the plurality of fluid outlets in the zones 132, 134, 136, 138, 140, and 142 (as shown in FIG. 4A) can be seen. Openings 180, 182, 194, 196, 188, and 190 which are located in a bottom portion of the platen 110 lead to the radial rows of a plurality of fluid inlets/outlets forming the zones 132, 134, 136, 138, 140, and 142 respectively. It should be appreciated that the openings 180, 182, 194, 196, 188, and 190 on the bottom portion of the platen 110 may be any suitable type or shape of aperture that would enable movement of fluid to and from the zones 132, 134, 136, 138, 140, and 142. In one embodiment, the openings 180, 182, 194, 196, 188, and 190 are annular in shape and form concentric openings which are connected with the apertures in zones 132, 134, 136, 138, 140, and 142. Fluid input or output to each of the openings 180, 182, 194, 196, 188, and 190, may be individually controlled so the zones 132, 134, 136, 138, 140, and 142 containing the plurality of fluid inlets and outlets may be managed to either increase or decrease polishing pressure on different parts of the wafer. It should be understood that each of the zones 132, 134, 136, 138, 140, and 142 may be configured to either output fluid or input fluid depending on the polishing profile desired. For example, in one embodiment, the zones 132, 134, and 136 may output fluid to the fluid bearing between the polishing pad and the platen to apply polishing pressure. In such an embodiment, the zones 138, 140, and 142 may input fluid from the fluid bearing into the platen to remove polishing pressure for those corresponding regions of the wafer. In one embodiment, fluid pressure to the openings 180, 182, 194, 196, 188, and 190 may each be independently controlled to produce multiple pressure zones above the platen 110.

Figure 4C:
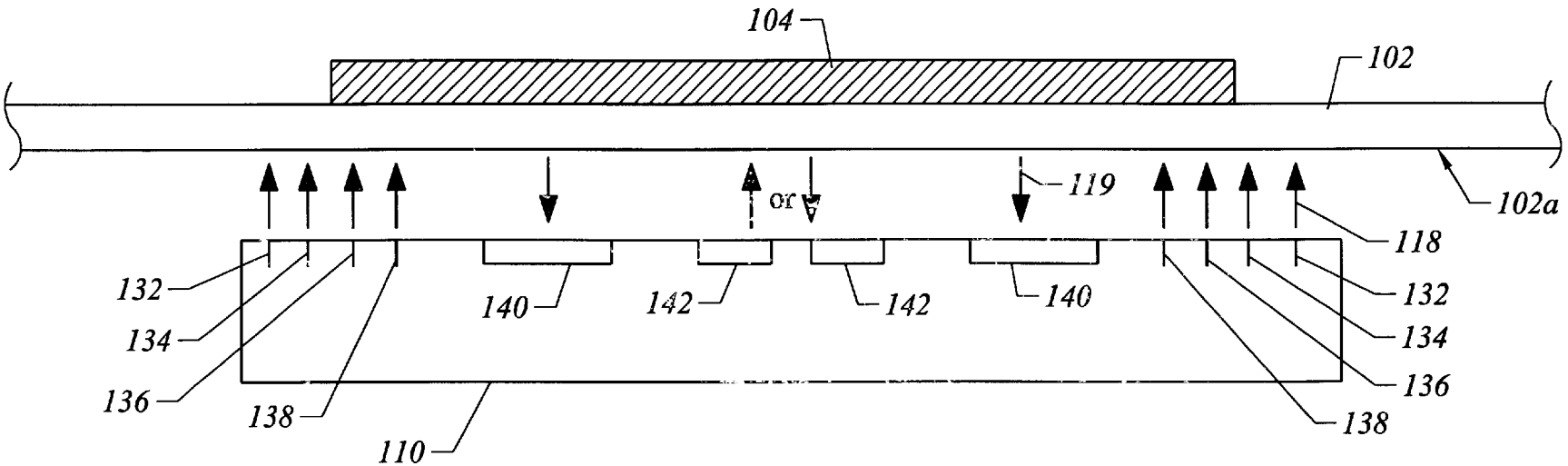
FIG. 4C illustrates a side view of the platen with the platen zone layout in accordance with one embodiment of the present invention.

FIG. 4C illustrates a side view of the platen 110 with the platen zone layout 130 in accordance with one embodiment of the present invention. In this embodiment, the zones 132, 134, 136, and 138 output fluid to generate a fluid bearing thereby increasing polishing pressure. The zone 140 may input fluid from the fluid bearing into the platen 110 thereby reducing polishing pressure. The zone 142 may either output fluid or input fluid to either increase polishing pressure or decrease polishing pressure.

Figure 5:
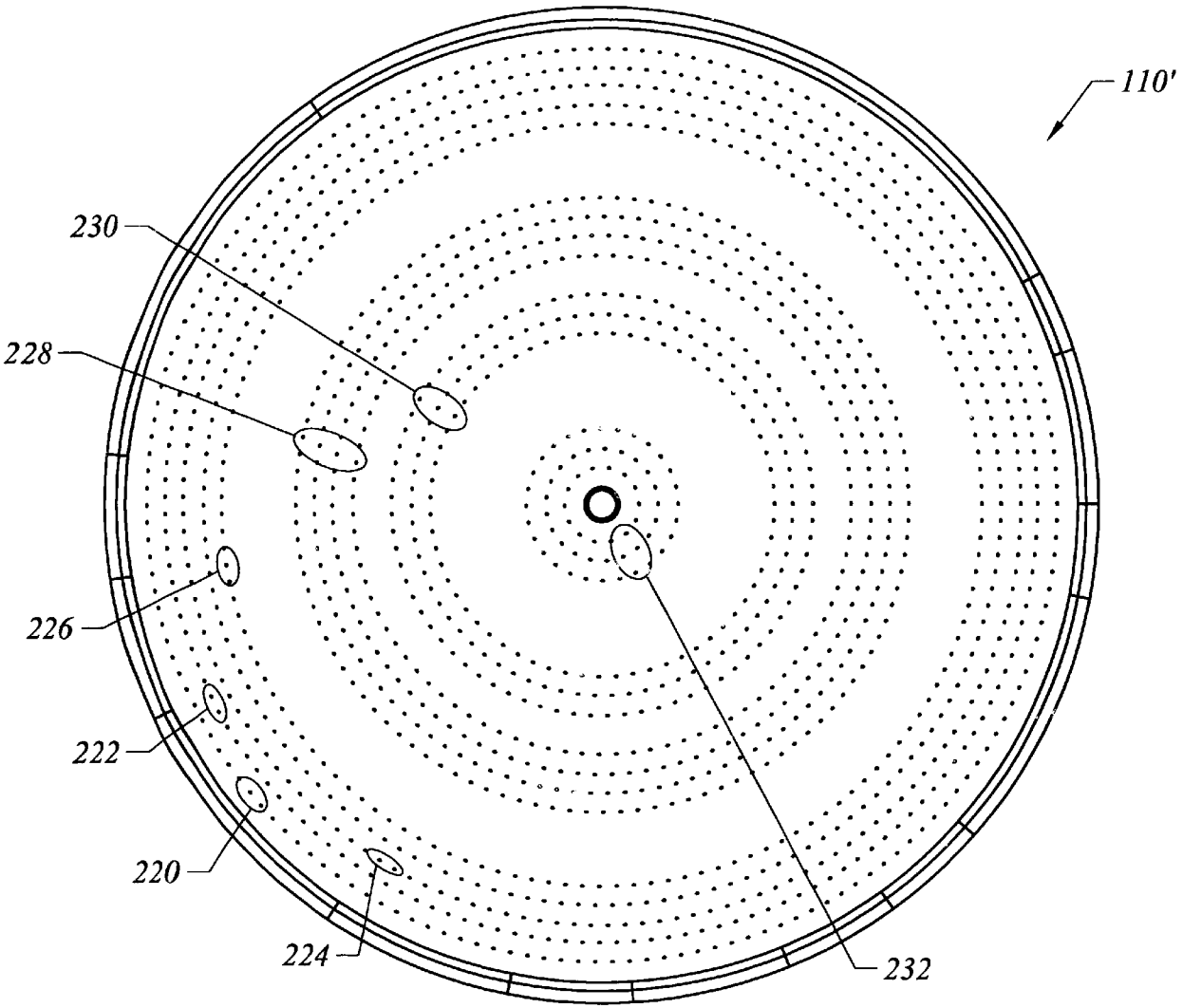
FIG. 5 illustrates a platen with a 300 mm platen layout in accordance with one embodiment of the present invention.

FIG. 5 illustrates a platen 110" with a 300 mm platen layout in accordance with one embodiment of the present invention. In this embodiment, the platen 110" includes 8 different zones where fluid may be inputted or outputted. The 8 different zones include zones 220, 222, 224, 226, 228, 230, and 232. It should be understood that any, some or all of the zones 220, 222, 224, 226, 228, 230, and 232 (and also any suitable zones in other platens described herein) may be either a fluid input zone or a fluid output zone. It should be appreciated that the zones may be configured to be a fluid input zone or a fluid output zone in any suitable manner. In one embodiment, each of the radial rows of holes that make up the fluid outlets and the fluid inlets may be connected to a three way valve. The three way valve can be operated so any of the radial rows of holes may utilized as an outlet or an inlet. In one embodiment, a first passageway, a second passageway, and a third passageway of the three way valve may be connected to a particular radial row of holes, a fluid supply, and a fluid vent respectively. In this way, by managing the three way valve, a fluid input zone may be changed to a fluid output zone and vice versa. Therefore, depending on which valve is opened and closed, the passageways connecting the particular radial row of holes and the fluid supply may be connected for a fluid outlet configuration or the passageways connecting the particular radial row of holes and the fluid vent may be connected for a fluid venting configuration. In this way any of the radial rows of holes may be made into a fluid output zone or a fluid input zone. It should be appreciated that the three way valve may be used in any of the platen configurations described herein to generate a fluid output zone or a fluid input zone. Therefore, polishing profiles may be precisely controlled so a wafer with an non-uniform deposition of substances may be polished in a way that can result in a substantially planar wafer surface.

FIG. 6A shows a graph 280 illustrating a polishing profile of a wafer in accordance with one embodiment of the present invention. The graph 280 has a y-axis showing normalized removal rate and an x-axis representing center to edge distance of the wafer. The graph 280 depicts the polishing profile where a wafer is polished. In prior art platens, difficulties arose especially in the wafer area between a radius of about 20 mm to about 88 mm from the center of the wafer. In those areas, in one example, due to non-uniform oxide deposition on the wafer, oxide deposition thicknesses can vary. For example, by having fluid output and fluid input zones, polishing of almost all areas of the wafer may be varied and adjusted. The line 282 illustrates a polishing profile that may be utilized to polish a wafer thickness profile where the oxide deposition thickness is thicker in an edge region of the wafer and thinner in the center region of the wafer.

Therefore, as shown by the diagram 280, the removal rates at different regions of the wafer may be adjusted to correspond to how thick the oxide deposition is in that region. To put it another way, polishing pressure may be varied over different zones of the platen so regions of the wafer with thick oxide deposition can have a higher removal rate than regions of the wafer with thin oxide deposition. As a result, by use of the platen described herein, a wafer with a non-uniform oxide layer thickness may be planarized to form a substantially uniform oxide layer thickness. It should be understood that although optimizing the planarization of an oxide layer is described, the platen may be utilized to planarize any other suitable type of material. Therefore, use of the platen described herein leads to improved wafer production efficiency and lower wafer production costs.

It should be appreciated that the above conditions are only exemplary in nature and other polishing conditions may be used with the apparatus described herein to obtain an optimized polishing profile while reducing fluid usage.

FIG. 6B shows a graph 290 illustrating an additional polishing profile of a wafer in accordance with one embodiment of the present invention. The graph 290 has a y-axis showing normalized removal rate and an x-axis representing center to edge distance of the wafer. The line 292 illustrates a polishing profile that may used with the platen described herein to polish a wafer thickness profile where the oxide deposition thickness is thicker in the center and the edge region of the wafer.

Therefore, the removal rates at different regions of the wafer corresponds to how thick the oxide deposition is in that region and polishing pressure may be varied over different zones of the platen so regions of the wafer with thick oxide deposition can have a higher removal rate than regions of the wafer with thin oxide deposition. As a result, by use of the platen described herein, a wafer may be planarized to form a substantially uniform oxide layer thickness. It should be appreciated that the above conditions are only exemplary in nature and other polishing conditions may be used with the apparatus described herein to obtain an optimized polishing profile while reducing fluid usage.

Figure 7:
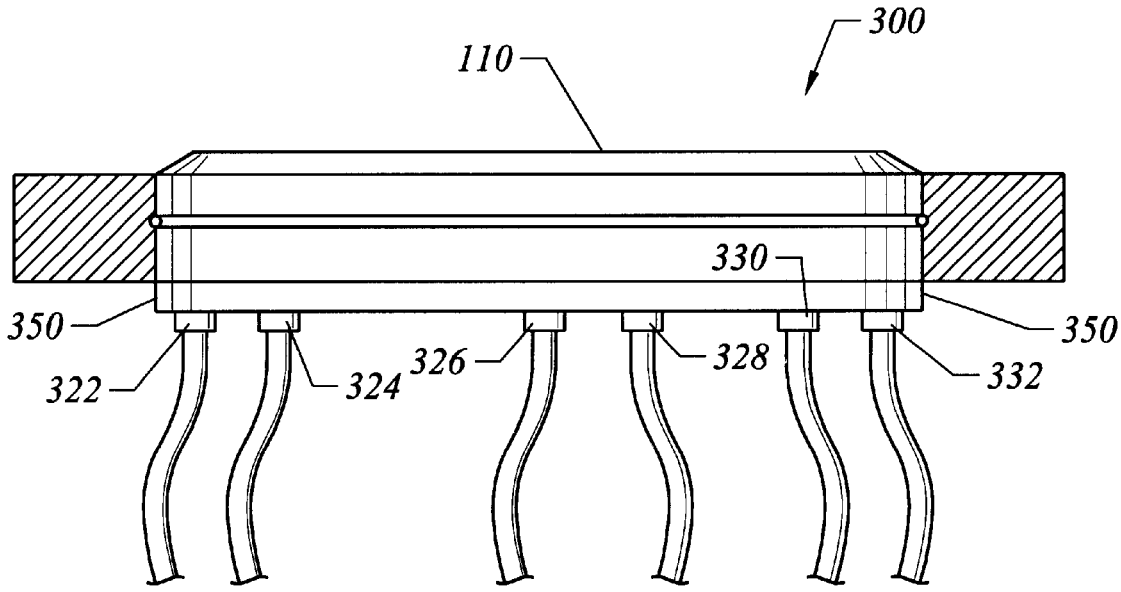
FIG. 7 shows a platen assembly with a platen and a platen interface assembly in accordance with one embodiment of the present invention.

FIG. 7 shows a platen assembly 300 with a platen 110 and a platen interface assembly 350 in accordance with one embodiment of the present invention. It should be understood that the platen assembly 300 may be a one piece apparatus with the regions including the plurality of outlet holes built into the one piece apparatus, or the platen assembly 300 may include a multi-piece apparatus including the platen 110 attached to the platen interface assembly 350. Regardless of the construction of the platen assembly 300, it may control fluid pressure through use of different plurality of outlet holes in different zones of the platen 110. In one embodiment, the platen assembly 300 includes the platen 110 which has multiple zones of the plurality of fluid output zones and a plurality of fluid input zones. The platen assembly 300 may include inputs/outputs 322, 324, 326, 328, 330, and 332 which may introduce or remove fluid into the different zones of the platen assembly 300. In one embodiment, each one of the input/outputs may correspond with each one of the fluid input and output zones on the platen 110 so each of the fluid output zones may be fed by an input and each of the fluid input zones may release fluid through an output. In one embodiment, the inputs/outputs 322, 324, 326, 328, 330, and 332 may be attached to openings 180, 182, 184, 186, 188, and 190 as shown in FIG. 4B. It should be appreciated that with other platen designs described herein with a different number of fluid input zones and fluid output zones, a corresponding number of associated inputs/outputs of the platen assembly 300 may be utilized.

Figure 8:
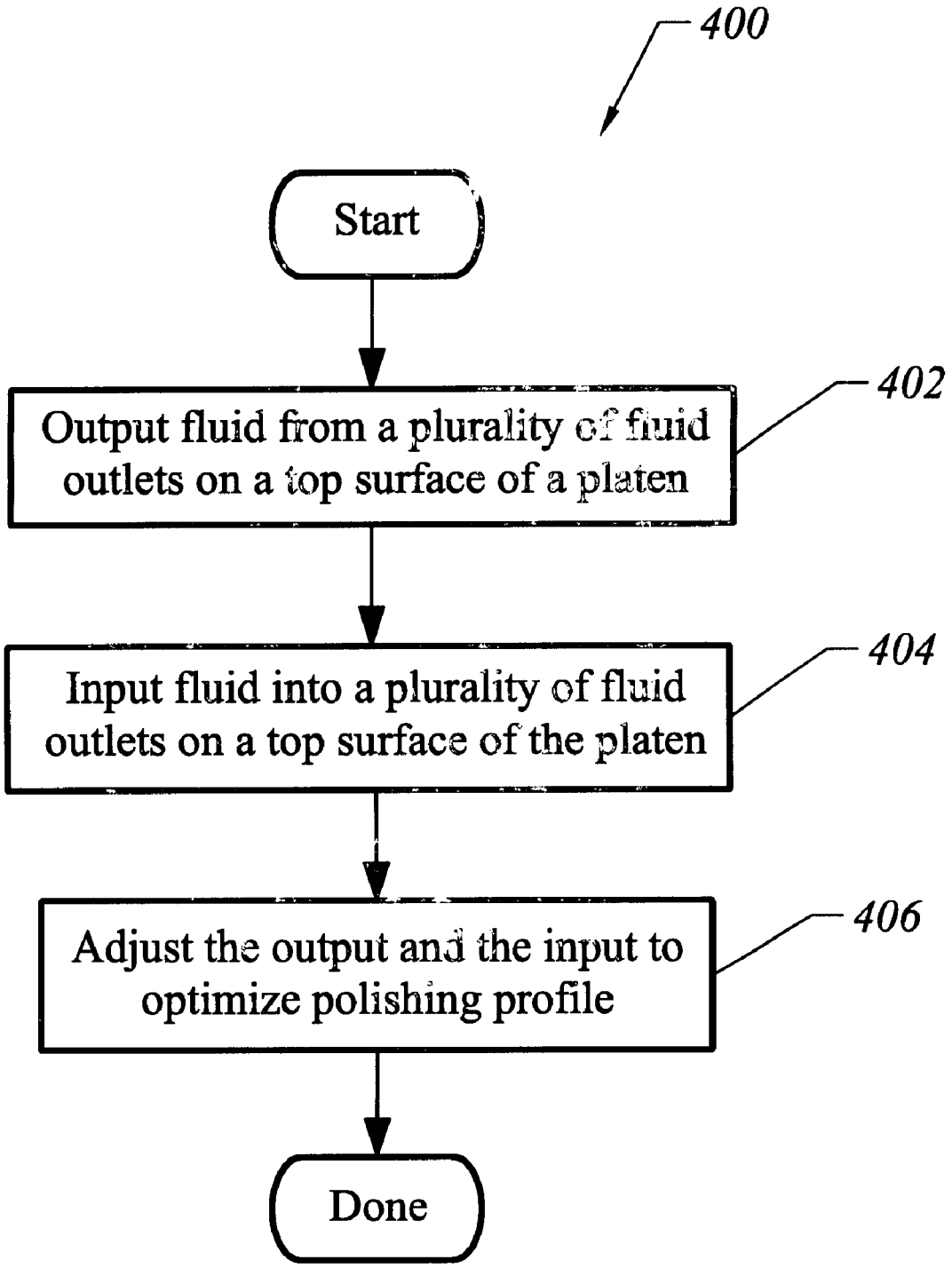
FIG. 8 illustrates a flowchart that defines a functionality of the platen in accordance with one embodiment of the present invention.

FIG. 8 illustrates a flowchart 400 that defines a functionality of the platen 110 in accordance with one embodiment of the present invention. The method begins with operation 402 which outputs fluid from a plurality of fluid outlets on a top surface of a platen. In this operation, a fluid bearing is generated between the platen and the polishing pad. By applying more fluid pressure from the plurality of fluid outlets, more polishing pressure can be applied to a region of the wafer corresponding to the platen zone where the plurality of fluid outlets are located. In addition, by having independently controllable zones with independently controllable radial rows of fluid outlets, each platen zone may apply different polishing pressure to different parts of the wafer.

After operation 402, the method moves to operation 404 which inputs fluid into a plurality of fluid inlets on a top surface of the platen. Operation 404 removes fluid from the fluid bearing between the platen and the polishing pad. By removing fluid from certain zones, polishing pressure may be reduced in those areas.

Then operation 406 adjusts the output and the input to optimize polishing profile. Therefore, by increasing polishing pressure on certain portions of the wafer while decreasing polishing pressure on other portions of the wafer, the polishing profile of the wafer may be optimally controlled. In circumstances where deposition of materials on the wafer has led to non-uniform thickness of the deposed layer, the polishing profile may be managed so removal rates in areas of thickness may be increased while removal rates in areas of thinness may be decreased. Therefore, a substantially planar surface may result after the polishing has been completed. In one embodiment, each of the zones may be independently controlled so at any suitable time, the zones may be changed from input to output or vice versa so polishing pressure may be added or removed from almost any wafer region at almost any time.

It should also be appreciated any suitable type of polishing pad may be effectively utilized with platen described herein including, polymeric polishing belts, stainless steel supported polishing belts, multilayer supported polishing belts, etc. Therefore, the platen can enhance wafer polishing uniformity in a wide variety of CMP systems.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A platen for use in a chemical mechanical planarization (CMP) system, comprising:

at least one configurable fluid output zone having a plurality of configurable fluid outlets, the at least one configurable fluid output zone being disposed below a polishing pad coupled to a first input/output and being capable of providing fluid pressure to the polishing pad; and at least one configurable fluid input zone having a plurality of configurable fluid inlets, the at least one configurable fluid input zone being disposed below the polishing pad coupled to a second input/output and being capable of removing the fluid pressure, wherein the platen is capable of managing fluid pressure applied to the polishing pad to achieve a particular polishing profile during a CMP operation.

2. A platen for use in a chemical mechanical planarization (CMP) system as recited in claim 1, wherein the fluid is one of a gas and a liquid.

3. A platen for use in a chemical mechanical planarization (CMP) system as recited in claim 2, wherein the gas is clean dry air.

4. A platen for use in a chemical mechanical planarization (CMP) system as recited in claim 1, wherein the platen is one of a 200 mm platen and a 300 mm platen.

5. A platen for use in a chemical mechanical planarization (CMP) system, as recited in claim 1, wherein the plurality of configurable fluid outlets form at least one concentric ring.

6. A platen for use in a chemical mechanical planarization (CMP) system, as recited in claim 1, wherein the plurality of configurable fluid inlets form at least one concentric ring.

7. A platen for use in a chemical mechanical planarization (CMP) system as recited in claim 5, wherein output from each of the at least one concentric ring is controlled independently.

8. A platen for use in a chemical mechanical planarization (CMP) system as recited in claim 6, wherein input into each of the at least one concentric ring is controlled independently.

9. A method for wafer planarization using a linear chemical mechanical planarization (CMP) system, the CMP system including a platen with at least one configurable fluid input zone and at least one configurable fluid output zone disposed below a polishing pad, comprising:

outputting fluid from at least one configurable fluid output zone coupled to a first input/output to an underside of the polishing pad to increase fluid pressure on the polishing pad; and inputting fluid into at least one configurable fluid input zone coupled to a second input/output to decrease fluid pressure on the polishing pad;

wherein increasing fluid pressure on the polishing pad increases polishing pressure on a wafer and decreasing fluid pressure on the polishing pad decreases polishing pressure on the wafer, and each of the at least one configurable fluid output zone and each of the at least one configurable fluid input zone being capable of being managed to achieve a particular polishing profile.

10. A method for wafer planarization as recited in claim 9, wherein the fluid is one of a gas and a liquid.

11. A method for wafer planarization as recited in claim 10, wherein the gas is clean dry air.

12. A method for wafer planarization as recited in claim 9, wherein the platen is one of a 200 mm platen and a 300 mm platen.

13. A method for wafer planarization as recited in claim 9, wherein the plurality of configurable fluid outlets form at least one concentric ring.

14. A method for wafer planarization as recited in claim 9, wherein the plurality of configurable fluid inlets form at least one concentric ring.

15. A method for wafer planarization as recited in claim 13, wherein output from each of the at least one concentric ring is controlled independently.

16. A method for wafer planarization as recited in claim 14, wherein venting into each of the at least one concentric ring is controlled independently.

17. A platen, comprising:

a surface capable of supporting a portion of a polishing pad;

a plurality of configurable outlets located throughout the surface, each of the plurality of configurable outlets coupled to a first input/output being capable of outputting a fluid toward an underside of the polishing pad; and a plurality of configurable inlets located throughout the surface, each of the plurality of configurable inlets coupled to a second input/output being capable of venting the fluid away from the underside of the polishing pad.

18. A platen as recited in claim 17, wherein the fluid is one of a gas and a liquid.

19. A platen as recited in claim 18, wherein the gas is clean dry air.

20. A platen as recited in claim 17, wherein the platen is one of a 200 mm platen and a 300 mm platen.

21. A platen as recited in claim 17, wherein the plurality of configurable fluid outlets form at least one concentric ring.

22. A platen as recited in claim 17, wherein the plurality of configurable fluid inlets form at least one concentric ring.

23. A platen as recited in claim 21, wherein output from each of the at least one concentric ring is controlled independently.

24. A platen as recited in claim 22 wherein venting into each of the at least one concentric ring is controlled independently.

25. A platen for use in a chemical mechanical planarization (CMP) system as recited in claim 1, wherein the at least one configurable fluid output zone and the at least one configurable input zone are connected to at least one valve.

26. A platen for use in a chemical mechanical planarization (CMP) system as recited in claim 25, wherein the at least one valve is capable of configuring the at least one configurable fluid output zone to at least one configurable fluid input zone.

27. A platen for use in a chemical mechanical planarization (CMP) system as recited in claim 25, wherein the at least one valve is capable of configuring the at least one configurable fluid input zone to at least one configurable fluid output zone.

28. A method for wafer planarization as recited in claim 9, wherein configuring the at least one configurable fluid output zone and the at least one configurable fluid input zone occurs with a valve.

29. A platen as recited in claim 17, wherein the plurality of configurable outlets is capable of being configured to the plurality of configurable inlets.

30. A platen as recited in claim 17, wherein the plurality of configurable inlets is capable of being configured to the plurality of configurable outlets.

* * * * *